United States Patent [19]

Wengert

[11] Patent Number: 4,752,506

[45] Date of Patent: Jun. 21, 1988

[54] METHOD AND COMPOSITION FOR TREATING WOMEN'S HOSE TO PREVENT RUNS

[76] Inventor: Irene L. Wengert, 15465 Golden Star Ave., Riverside, Calif. 92506

[21] Appl. No.: 1,906

[22] Filed: Jan. 9, 1987

[51] Int. Cl.[4] ..... B05D 3/04

[52] U.S. Cl. ..... 427/348; 427/378; 427/389.9

[58] Field of Search ..... 427/389.9, 348, 378; 428/253, 254

[56] References Cited

U.S. PATENT DOCUMENTS 3,455,771 7/1969 Ichim et al. ..... 428/254

*Primary Examiner*—James J. Bell

*Attorney, Agent, or Firm*—Grant L. Hubbard

[57] ABSTRACT

Articles of clothing formed of knitted fibers in which the article of clothing is substantially saturated with an aqueous solution containing to 10 percent polyvinyl alcohol and 1 to 30 percent glycol plasticizer; configuring the article and thereafter drying.

10 Claims, No Drawings

METHOD AND COMPOSITION FOR TREATING WOMEN'S HOSE TO PREVENT RUNS

FIELD OF THE INVENTION

This invention relates to a composition of matter suitable for treating hose and other knitted articles to prevent runs, and run resistant hose and other knitted fabric articles of clothing.

BACKGROUND OF THE INVENTION

In general, women's sheer full fashioned hosiery, in particular, and other knitted clothing generally is subject to runs and tears. Runs from minor punctures or small holes in the hosiery and are at least unsightly and frequently destroy the article. The prior art has provided a sizing composition for yarns derived from synthetic fiber forming polymeric amides, which substantially reduces the percentage of imperfect and defective stocking, See, U.S. Pat. No. 2,565,962 issued on Aug. 28, 1951, but has not eliminated the problems of runs which appears to be an inherent characteristic of many fine yarns for women's hose.

Manufacturers have attempted to prevent runs due to punctures in the hose from toenails, by reenforcing the toenail area of the hosiery with more fibers, but this has not eliminated runs in other areas of the stocking. Furthermore, the thicker fibers may be aesthetically displeasing or uncomfortable to the user. A method at stopping the runs after they begin by applying compositions to the run area in the hose, such as nail polish, does not solve the initial problem nor is such a method practical as it can cost more than purchasing new hosiery.

A composition and method are provided within the scope of this invention for preventing runs from occurring. A treated pair of hose, or other knitted clothing, is also contemplated within the scope of the invention.

SUMMARY OF THE INVENTION

A method of run-proofing completed articles of clothing formed of knitted fine fibers is disclosed, comprising the steps of saturating the article of clothing to be run-proofed in an aqueous solution of from about 1 to about 10 weight percent polyvinyl alcohol and from about 1 to about 30 weight percent glycol plasticizer, and thereafter drying the article in a configuration in which fabric layers of the article do not dry adjacent one another in sufficient proximity to stick the layers of fabric of which the article is formed together.

The preferred polyvinyl alcohols are substantially fully hydrolyzed.

It is highly advantageous that the polyvinyl alcohol be soluble in hot water but substantially insoluble in cold water and, in a preferred embodiment, the solution comprises from about 2 to about 6 weight percent polyvinyl alcohol and from about 6 to about 18 weight percent glycol plasticizer, the preferred plasticizers comprising glycerol, ethylene glycol or mixtures of glycerol and ethylene glycol.

In another facet, the invention is embodied in an article of clothing manufactured of knitted fibers which normally runs when fibers thereof are cut or broken, the article being improved in that the article is coated with a layer of glycol plasticized polyvinyl alcohol, the coating being so disposed as to coat the individual fibers and the intersections of the fibers but not the openings between fibers. As in the method, the glycol plasticizer is preferably glycerol, ethylene glycol or mixtures of glycerol and ethylene glycol, and is present in a ratio of from 1 to four times the amount of polyvinyl alcohol, and 1:1 to 2:1 ethylene glycol:glycerol ratio in the glycol is preferred.

DESCRIPTION OF THE PREFERRED EMBODIMENT

The specific formulations, methods, and compositions described herein are intended to exemplify the invention, to provide adequate information to permit those skilled in the art to carry out the best mode known to the inventor, and to provide guidance in applying the invention, and not in any way to limit the scope of the invention.

In general, the method of the invention comprises saturating the article to be treated, for example, hose knitted of fine textile fibers, in an aqueous solution of polyvinyl alcohol, and drying the article in a configuration which will prevent sticking of the portions of the article one to another.

A typical, non-limiting example of a suitable solution for carrying out the invention comprises:

TABLE I

| | |
|---|---|
| Water (preferably deionized) | 80–95%* |
| Polyvinyl alcohol | 2–6% |
| Glycol Plasticizer | 4–16% |

*Percentages are by weight.

The composition may, optionally, include traces (usually less than 1%) of preservatives, flatting agents, dyes and other minor constituents.

For example, a preservative such as, by way of example only, calcium or sodium propionate, Dowicide A (trademark of Dow Chemical Co.), Mitrol (trademark of Chapman Chemical Co.), or any other physiologically acceptable mold and bacteria inhibitor may be used. Flatting agents such as silica and, quite surprisingly, potassium acid tartrate (cream of tartar) may also be included if desired; however, flatting agents are not required in most applications.

Generally, formulations within the following ranges will be quite satisfactory for use in carrying out the invention:

TABLE II

| | |
|---|---|
| Water | 70 to 95% |
| Polyvinyl alcohol | 1 to 10% |
| Glycol | 1 to 30% |
| Preservatives, flatting agents, etc. | 0 to 5% |

The glycol plasticizer is preferably glycerol, ethylene glycol or mixtures of glycerol and ethylene glycol, and is present in a ratio of from 1 to four times the amount of polyvinyl alcohol. Mixtures of these glycols generally comprise from 1 to 2 parts of ethylene glycol for each part of glycerol.

It has been found that a particular blend of polyvinyl alcohols is especially advantageous. This blend comprises from about 0.5 to 2 parts of a fully hydrolyzed, hot water soluble, cold water insoluble polyvinyl alcohol having a high viscosity of 55–65 cps in 4% aqueous solution (Air Products and Chemicals, Inc. "VINOL 165" [Trademark]) and from 0.5 to 2 parts of a fully hydrolyzed, hot water soluble, cold water insoluble polyvinyl alcohol having a medium viscosity of 27–33 cps in 4% aqueous solution (DuPont Company "Elvanol 71-30" [Trademark]) in a solution of from about 1 to 2% to about 6%, typically about 4% in water, with about three times as much glycol, i.e. from about 3 to about 18% glycol, preferably a blend of about 1.25 parts of ethylene glycol to each part of glycerol.

A mixture, as indicated above, is formed as a slurry and is then boiled (100 degrees C. at one (1) atmosphere), stirred to complete dissolution, and allowed to cool. The solution may be reboiled just prior to packaging or packaged in an air tight container and then heated to sterilize the solution. In most instances, sterile packaging is sufficient and no preservative is required, but a preservative as suggested above may be added.

In use, the method is carried out by saturating the hose, or other knitted article, and drying the article in a suitable configuration to prevent large areas of the fabric of which the article is constructed from lying sufficiently close that sticking of one layer to another occurs. In the case where the article is hosiery, the hose may be dried over a loosely rolled tube of suitable material such as, for example, Saran Wrap (Trademark of Dow Chemical Company) polyvinylidine chloride film), polyethylene film, wax paper, etc. The article may, however, be hung appropriately or arranged by any other means to prevent sticking of the layers of fabric one to another.

In another aspect of the process of this invention, the hosiery is saturated with the plasticized polyvinyl alcohol and the placed over the nozzle of a hair dryer, or any source of a stream of air, preferably warm or hot air, such as emanates from a conventional hair dryer. This expands and inflates the hosiery to prevent layers from contacting each other and contributes to the drying step. This approach is considered ideal for the production line application of the present process.

The plasticized polyvinyl alcohol is believed to form a film which coats the individual fibers and bonds the intersection of the fibers with each other but does not form a film covering the openings between the fibers. The film on the intersection of the fibers is believed to prevent the formation of runs. Whatever the mechanism of the phenomenon, the results are striking, Very sheer hose which is highly susceptible to running become totally run-proof!

INDUSTRIAL APPLICATION

This invention finds practical utility in the garment industry and, most importantly, by individuals who desire to protect their knitted hosiery and other articles from runs.

What is claimed is:

1. A method of run-proofing completed articles of clothing formed of knitted fine fibers comprising:

substantially saturating the article of clothing to be run-proofed in an aqueous solution of from about 1 to about 10 weight percent polyvinyl alcohol and from about 1 to about 30 weight percent glycol plasticizer;

configuring the article such that layers thereof are not in direct contact; and thereafter drying the article in said configuration whereby said layers do not stick together during drying.

2. The method of claim 1 wherein the polyvinyl alcohol consists essentially of substantially fully hydrolyzed polyvinyl alcohol.

3. The method of claim 1 wherein the polyvinyl alcohol is soluble in hot water but substantially insoluble in cold water.

4. The method of claim 3 wherein the solution comprises from about 2 to about 6 weight percent polyvinyl alcohol and from about 6 to about 18 weight percent glycol plasticizer.

5. The method of claim 4 wherein the glycol plasticizer comprises glycerol, ethylene glycol or mixtures of glycerol and ethylene glycol.

6. The method of claim 1 wherein the solution comprises from about 2 to about 6 weight percent polyvinyl alcohol and from about 6 to about 18 weight percent glycol plasticizer.

7. The method of claim 6 wherein the glycol plasticizer comprises glycerol, ethylene glycol or mixtures of glycerol and ethylene glycol.

8. A method of treating knitted hosiery comprising the steps of:

(a) substantially saturating a pair of finished knitted hosiery with an aqueous solution of glycol plasticized, substantially fully hydrolyzed polyvinyl alcohol;

(b) placing wet, saturated hosiery on a polymeric film support form; and (c) drying the hosiery on said support form.

9. A method of treating knitted hosiery comprising the steps of:

(a) substantially saturating a pair of finished knitted hosiery with an aqueous solution of glycol plasticized, substantially fully hydrolyzed polyvinyl alcohol;

(b) injecting an air stream into the saturated hosiery of step (a) thereby expanding and inflating the hosiery; and (c) drying the hosiery in said expanded, inflated configuration.

10. A method of treating knitted hosiery comprising the steps of:

(a) substantially saturating a pair of finished knitted hosiery with an aqueous solution of glycol plasticized, substantially fully hydrolyzed polyvinyl alcohol;

(b) separating layers of said saturated hosiery; and (c) drying the hosiery with the layers thereof substantially separated.

* * * * *